US006772831B2

(12) United States Patent
Yamamoto et al.

(10) Patent No.: US 6,772,831 B2
(45) Date of Patent: Aug. 10, 2004

(54) HEAT EXCHANGER AND METHOD FOR MANUFACTURING THE SAME

(75) Inventors: Tetsuya Yamamoto, Chita-gun (JP); Seiichi Kato, Toyoake (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/357,100

(22) Filed: Feb. 3, 2003

(65) Prior Publication Data

US 2003/0127216 A1 Jul. 10, 2003

Related U.S. Application Data

(63) Continuation of application No. PCT/JP02/05628, filed on Jun. 6, 2002.

(30) Foreign Application Priority Data

Jun. 6, 2001 (JP) ..... 2001-171495

(51) Int. Cl.[7] ..... F28F 1/04
(52) U.S. Cl. ..... 165/151; 165/181; 29/890.047
(58) Field of Search ..... 165/151, 152, 165/153, 181; 29/890.044, 890.046, 890.047

(56) References Cited

U.S. PATENT DOCUMENTS 3,724,537 A * 4/1973 Johnson ..... 165/133
4,558,695 A 12/1985 Kumazawa et al.
4,570,317 A * 2/1986 Veling et al. ..... 29/890.046
4,633,939 A * 1/1987 Granetzke ..... 165/154
4,653,580 A * 3/1987 Steele ..... 165/153
5,604,982 A * 2/1997 Kent et al. ..... 29/890.044
5,640,879 A * 6/1997 Damsohn et al. ..... 72/479
5,669,440 A * 9/1997 Bauer et al. ..... 165/177

FOREIGN PATENT DOCUMENTS

| | | | |
|---|---|---|---|
| EP | 0903555 | 3/1999 | |
| EP | 0 984 240 | 3/2000 | |
| JP | 403023022 A * | 1/1991 | ..... 29/890.053 |
| JP | 8-42990 | 2/1996 | |
| JP | 9-96496 | 4/1997 | |
| JP | 9-136160 | 5/1997 | |
| JP | 10-185474 | 7/1998 | |
| JP | 10-288491 | 10/1998 | |
| JP | 11-320005 | 11/1999 | |
| JP | 2000-74589 | 3/2000 | |

* cited by examiner

*Primary Examiner*—Terrell McKinnon
(74) *Attorney, Agent, or Firm*—Harness, Dickey & Pierce, PLC

(57) ABSTRACT

Welds (111*a*) are provided in areas that are offset from curved portions (111*b*) where stress concentration is likely to occur. This allows excess stress to be inhibited to occur at the welds at the time of tube enlargement. Therefore, even if the welds are softened and proof stress (mechanical strength) is reduced at the time of welding, as the stress occurring at the welds at the time of the tube enlargement can be prevented from exceeding the proof stress (allowable stress) of the welds, the welded tubes can be adopted in a radiator in which the tubes (111) and the fins (112) are joined together mechanically by tube enlargement. As a result, the manufacturing cost of the tubes can be reduced in comparison with the case when seamless tubes are adopted as the tubes.

19 Claims, 15 Drawing Sheets

HEAT EXCHANGER AND METHOD FOR MANUFACTURING THE SAME

CROSS-REFERENCE TO RELATED APPLICATIONS

This application is based upon, and claims the priority of, Japanese Patent Application No. 2001-171495, filed Jun. 6, 2001, the contents being incorporated therein by reference, and is a continuation of PCT/JP02/05628.

BACKGROUND OF THE INVENTION

1. Field of the Invention

The present invention relates to a heat exchanger and a method for manufacturing the same, wherein tubes and fins are joined together mechanically by deforming the tubes plastically so as to increase cross-sectional areas of the tubes (hereinafter, this operation is referred to as "tube enlargement").

2. Description of the Related Art

In a heat exchanger in which tubes and fins are joined together mechanically, as the tubes are deformed plastically so as to increase the cross-sectional areas of the tubes by tube enlargement, tube material must have a relatively large elongation rate and, at the same time, it must be resistant to elongation. Therefore, conventionally (for example, in Japanese Unexamined Patent Publication No. 2000-74589), seamless tubes that are seamless and manufactured by drawing or extrusion processes are adopted as the tubes for the tube enlargement.

Here, it should be noted that the seamless tubes have a higher production cost than welded tubes (tubes manufactured by bending plate material in a tubular manner and then joining seams by welding) as the seamless tubes take more man-hours (thus have a higher production cost) than the welded tubes.

Therefore, the inventors of the present invention have studied to adopt the welded tubes in place of the seamless tubes in the heat exchanger in which the tubes and the plate fins are joined together mechanically, but, as welds in the welded tubes are softened due to heat at the time of welding in comparison with tube material (regions other than the welds) and have lower proof stress (mechanical strength), it is difficult to simply replace the seamless tubes with the welded tubes.

SUMMARY OF THE INVENTION

In view of the above problem, it is an object of the present invention to join tubes and fins together mechanically by tube enlargement in the case of using welded tubes.

In order to achieve the above object, according to an aspect of the present invention, there is provided a heat exchanger having tubes (111) through which fluid flows, and fins (112) for promoting heat exchange between one fluid flowing through the tubes (111) and air passing between the tubes (111), in which the tubes (111) and the fins (112) are joined together mechanically by deforming the tubes (111) plastically so as to increase cross-sectional areas of the tubes (111) in a state in which the tubes (111) are inserted through insertion holes **(112*a*) provided in the fins (112), wherein the tubes (111) are welded tubes manufactured by bending plate material to form flat tubes and then joining seams by welding, and welds (111*a*) of the tubes (111) are provided in areas that are offset from curved portions (111*b*)** formed at the ends in the length direction.

According to this aspect, as the welds **(111*a*) are provided in the areas that are offset from the curved portions (111*b*) where stress concentration is likely to occur, excess stress occurring at the welds (111*a*)** at the time of tube enlargement can be inhibited.

Therefore, even if the welds **(111*a*) are softened and proof stress (mechanical strength) is reduced at the time of welding, as the stress occurring at the welds (111*a*) at the time of the tube enlargement can be prevented from exceeding the proof stress (allowable stress) of the welds (111*a*), the welded tubes can be adopted in the heat exchanger in which the tubes (111) and the fins (112) are joined together mechanically. As a result, the manufacturing cost of the tubes 111 can be reduced in comparison with the case when the seamless tubes are adopted as the tubes (111)**.

According to another aspect of the present invention, the welds **(111*a*)** are provided in areas that substantially correspond to a center position in the length direction.

Therefore, as the stress occurring at the welds **(111*a*) can be reduced reliably, the reliability of the tubes (111)** can be improved further.

According to still another aspect of the present invention, depressions **(112*d*) that are depressed in the direction of padding of the welds (111*a*) are provided in areas of edges of the insertion holes (112*a*) that correspond to the welds (111*a*)**.

In this aspect, as the depressions **(112*d*) act as relief means for mitigating interference between the padding and the insertion holes (112*a*), clearances created between the tubes (111) and the fins (112) in the vicinity of the padding are reduced in comparison with the case in which the depressions (112*d*)** are not provided.

Therefore, as contact areas (thus heat conduction) between the tubes (111) and the fins (112) can be prevented from being reduced, heat exchange capacity can also be prevented from being reduced.

According to yet another aspect of the present invention, there is provided a heat exchanger having tubes (111) through which fluid flow, and fins (112) for promoting heat exchange between one fluid flowing through the tubes (111) and air passing between the tubes (111), in which the tubes (111) and the fins (112) are joined together mechanically by deforming the tubes (111) plastically so as to increase cross-sectional areas of the tubes (111) in a state in which the tubes (111) are inserted through insertion holes **(112*a*) provided in the fins (112), wherein the tubes (111) are welded tubes manufactured by bending plate material in a tubular manner and then joining seams by welding, and depressions (112*d*) that are depressed in the direction of padding of the welds (111*a*) are provided in areas of edges of the insertion holes (112*a*) that correspond to the welds (111*a*)**.

In this aspect, as the depressions **(112*d*) act as relief means for mitigating interference between the padding and the insertion holes (112*a*), clearances created between the tubes (111) and the fins (112) in the vicinity of the padding are reduced in comparison with the case in which the depressions (112*d*)** are not provided.

Therefore, as contact areas (thus heat conduction) between the tubes (111) and the fins (112) can be prevented from being reduced, the heat exchange capacity can also be prevented from being reduced.

Here, it is to be noted that the application of the present invention is not limited to the flat tubes, but it can also be applied to tubes of other shapes such as circular tubes and so on.

Further, according to the present invention, there is provided a method for manufacturing a heat exchanger, comprising the steps of: providing slits (210) for avoiding interference with padding in areas of tube enlargement jigs (200) for enlarging tubes (111) that correspond to the padding of the welds (111*a*), wherein a slit width (D) of the slits (210) is larger than a padding width (d) of the welds (111*a*) and a ratio (D/A) of the slit width (D) to a dimension (A) of areas that are parallel to the slit width (D) among outside dimensions of the tube enlargement jigs (200) is 0.32 or less; and joining the tubes (111) and the fins (112) mechanically by deforming the tubes (111) plastically by using the tube enlargement jigs (200).

Therefore, as shown in FIG. 17 described below, the tubes (111) and the fins (112) can be joined mechanically without reducing the heat dissipation capacity significantly.

Here, it is to be noted that reference numerals within parentheses attached to each means described above are shown exemplarily for indicating a relationship with specific means in the embodiments described below.

Hereinafter, the present invention will be more fully understood from the following description of the preferred embodiment thereof taken together with the accompanying drawings.

BEST MODE FOR CARRYING OUT THE INVENTION

A First Embodiment

Figure 1:
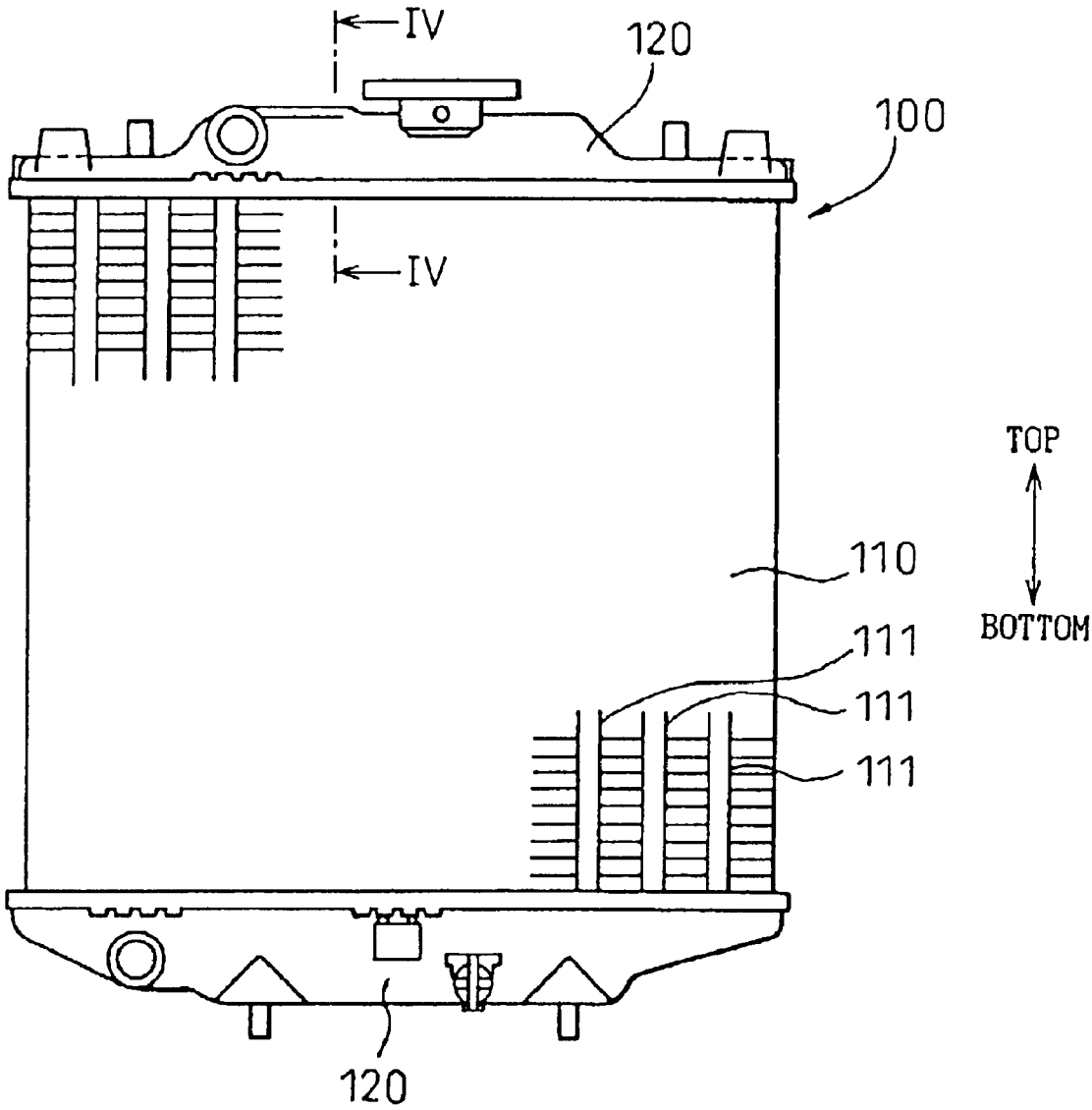
FIG. 1 is a front view of a heat exchanger according to an embodiment of the present invention.

In this embodiment, a heat exchanger according to the present invention is applied to a radiator for performing heat exchange between cooling water of an internal-combustion engine (engine) and air, and FIG. 1 is a front view of a radiator 100 according to this embodiment.

Figure 2:
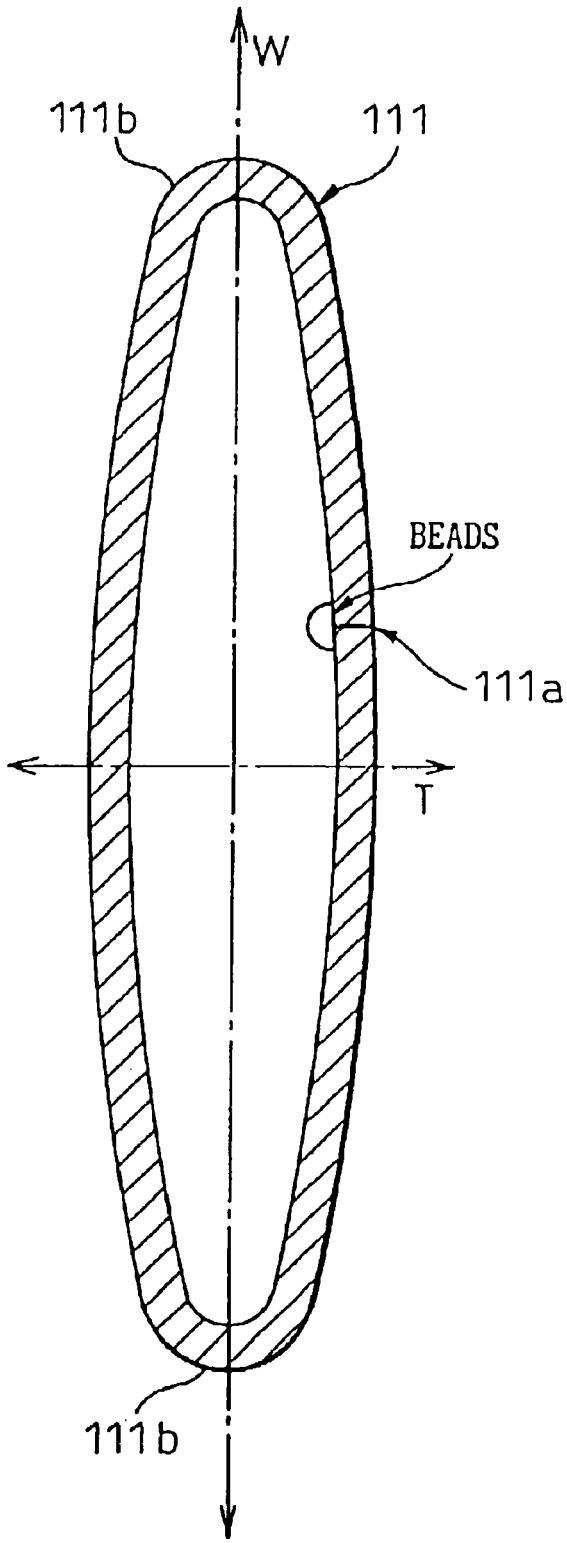
FIG. 2 is a cross-sectional view of a tube according to a first embodiment of the present invention.

In FIG. 1, tubes 111 are tubes made of metal (aluminum in this embodiment) through which cooling water circulates, and more specifically, the tubes 111 are welded tubes (electric resistance welded tubes) manufactured by bending plate material so as to form a flat (elliptical) cross-section as shown in FIG. 2 and then joining the seams by welding.

Then, a weld 111*a* in each of the tubes 111 is provided at a position that is offset from curved portions 111*b* that are formed at both ends in length direction W in the tube cross-section and have the smallest radius of curvature (in an area between two curved portions 111*b*) and, on its outer circumferential surface (on the surface which is in contact with plate fins 112 as described later), in turn, padding (welding beads) that is formed on the outer circumferential surface by welding is cut away by cutting (grinding) means such as a grinder to represent a smooth curved surface.

Figure 3:
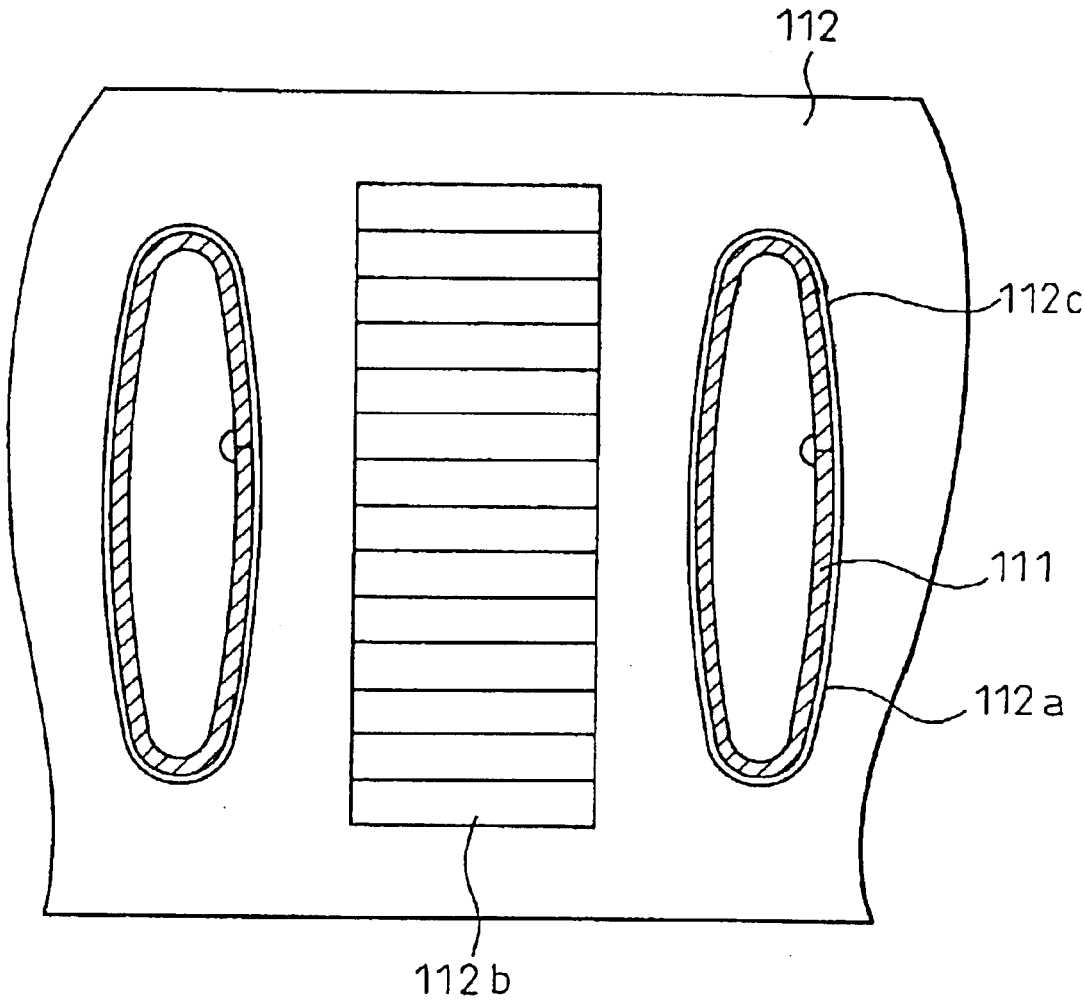
FIG. 3 is a front view showing joining relationship between the tubes and a fin according to the first embodiment of the present invention.

Further, in FIG. 1, fins 112 are plate fins made of metal (aluminum in this embodiment) that spread in the direction orthogonal to the longitudinal direction of the tubes 111 (vertical direction in FIG. 1) and extend in breadth direction T of the tubes 111 in a strip-like manner for facilitating heat exchange with the cooling water, and on each of the fins 112, as shown in FIG. 3, insertion holes 112*a* through each of which the tube 111 is inserted, and louvers 112*b* that are formed by cutting and raising portions of the fin 112 like blind windows for turning direction of the air circulating around the fins 112 so as to inhibit growth of a thermal boundary layer are provided by press or roller working.

Figure 4:
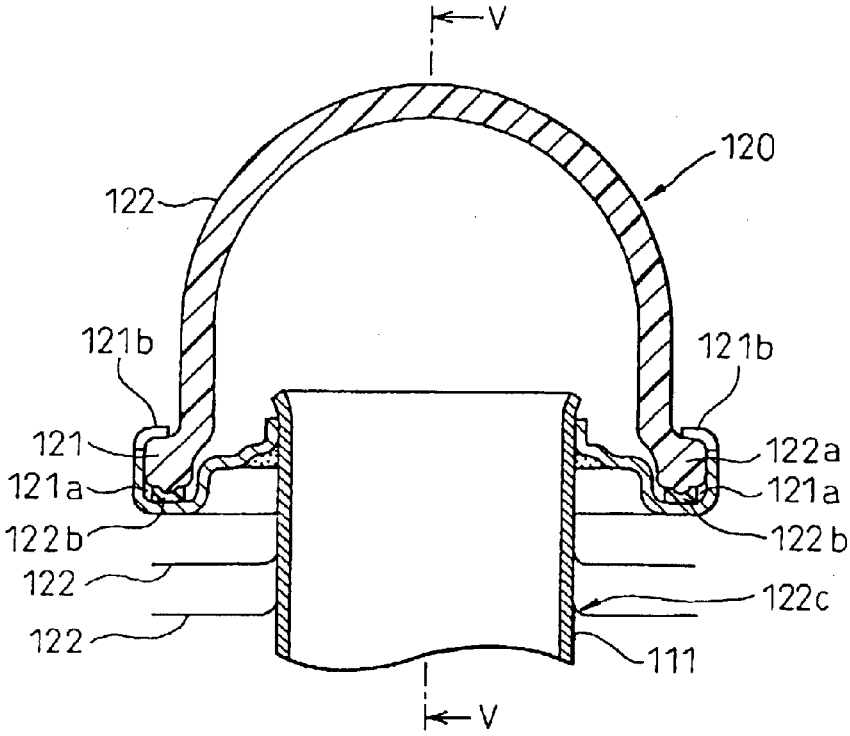
FIG. 4 is a cross-sectional view taken on line IV—IV of FIG. 1.
Figure 5:
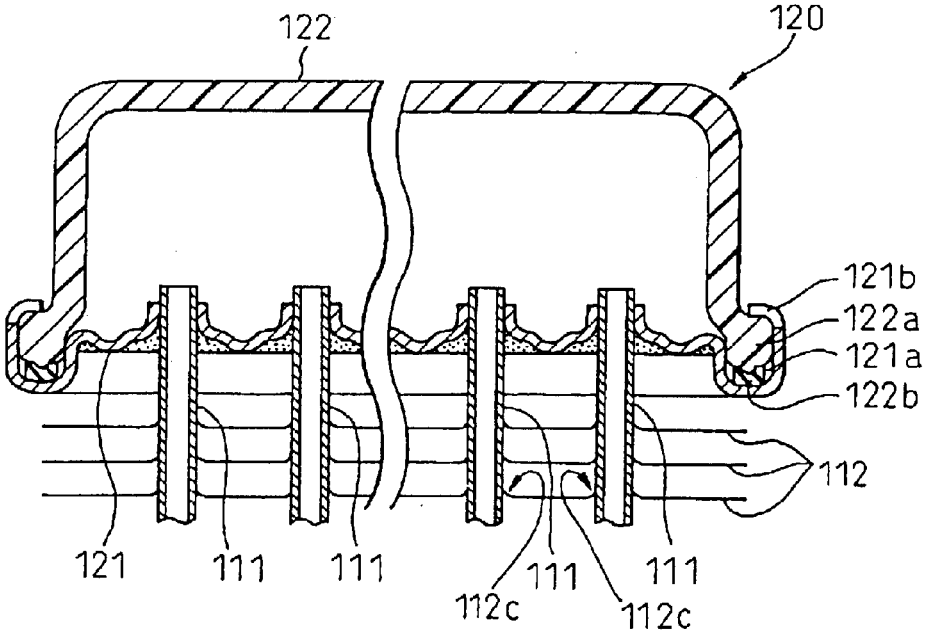
FIG. 5 is a cross-sectional view taken on line V—V of FIG. 4.

Further, in this embodiment, by forming the insertion holes 112*a* by burring, as shown in FIGS. 4 and 5, burring portions 112*c* each of which has a wall at the edge of each insertion hole 112*a* around the outer circumferential surface of each tube 111 are provided so as to increase contact areas between the tubes 111 and the fins 112 when the tubes are enlarged to join the fins 112 and the tubes 111 mechanically.

Then, a core portion 110 for performing heat exchange between cooling air and the cooling water is constituted by the tubes 111 and the fins 112, and a plurality of tubes 111 are arranged in line in the longitudinal direction of the fins 112 so that the length direction W of the tubes 111 is substantially parallel to the direction of the cooling air circulating outside the tubes 111.

In this connection, as shown in FIG. 1, header tanks 120 each of which extends in the direction orthogonal to the longitudinal direction of the tubes 111 to link with a plurality of tubes are joined to both ends in the longitudinal direction of the tubes 111, wherein, as shown in FIGS. 4 and 5, each of the header tanks 120 is comprised of a core plate 121 made of metal (aluminum in this embodiment) to which a plurality of tubes 111 are joined by tube enlargement, and a tank main body 122 made of resin (nylon in this embodiment) constituting intra-tank space along with the core plate 121.

It is to be noted here that one header tank 120 at the top side in FIG. 1 distributes the cooling water to each tube 111, while the other header tank 120 at the bottom side collects the cooling water flowing out from each tube 111.

Here, the core plate 121 and the tank main body 122 are joined by caulking as a result of plastic deformation so that a tip of a protrusion (a lug) 121*b* for caulking provided on the core plate 121 is bent to the side of the tank main body 122 when a tip portion 122*a* of the tank main body 122 is inserted into a groove 121*a* of the core plate 121.

It is to be noted here that a packing 122*b*, that is comprised of an elastic member such as rubber for making contact with the skirt portion (the tip portion) 122*a* to seal clearance between the tank main body 122 and the core plate 121, is disposed on the bottom of the groove 121*a*.

Further, in order to prevent leakage of the cooling water through clearances between the tubes 111 and the core plate. 121, in this embodiment, the clearances are sealed securely by an adhesive consisting of thermosetting resin or by soldering. Here, though the clearances are sealed by the adhesive or by soldering in this embodiment, the clearances may alternatively be welded by laser welding and the like.

Next, a method for enlarging the tube 111 (for connecting the tube 111 with the fin 112) will be described.

Figure 6B:
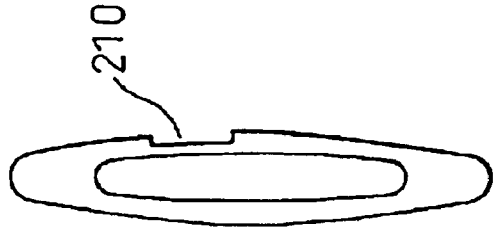
FIG. 6B is a view from arrow A of FIG. 6A.
Figure 6A:
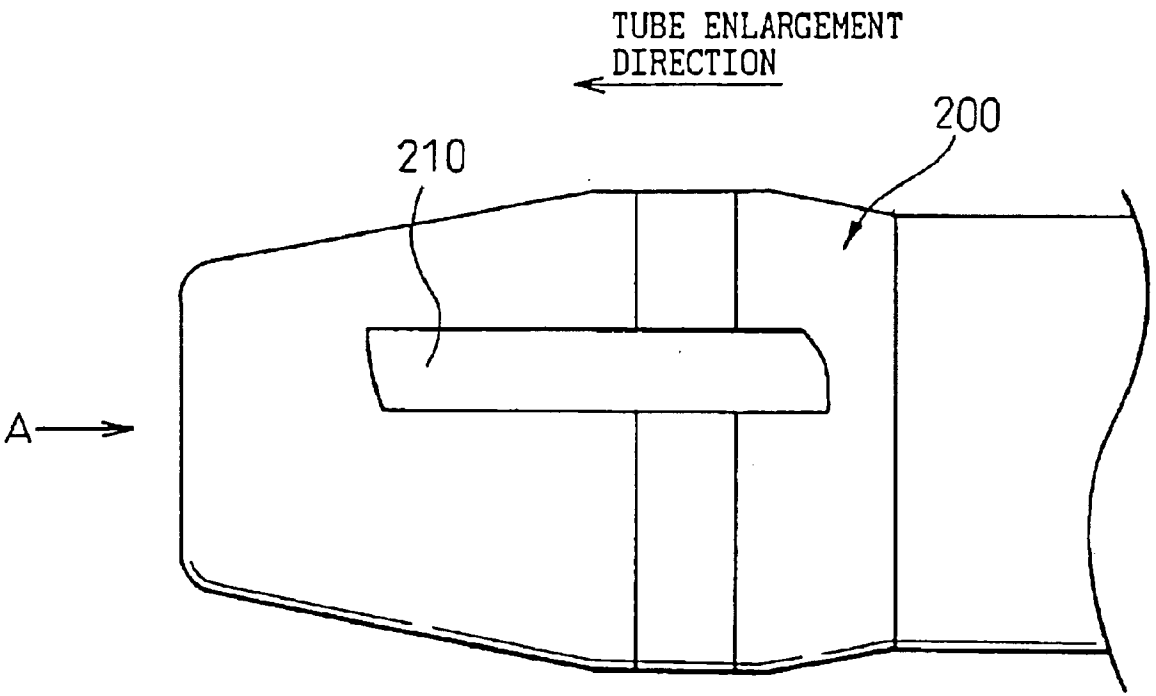
FIG. 6A is a front view of a tube enlargement jig according to the first embodiment of the present invention.
Figure 7A:
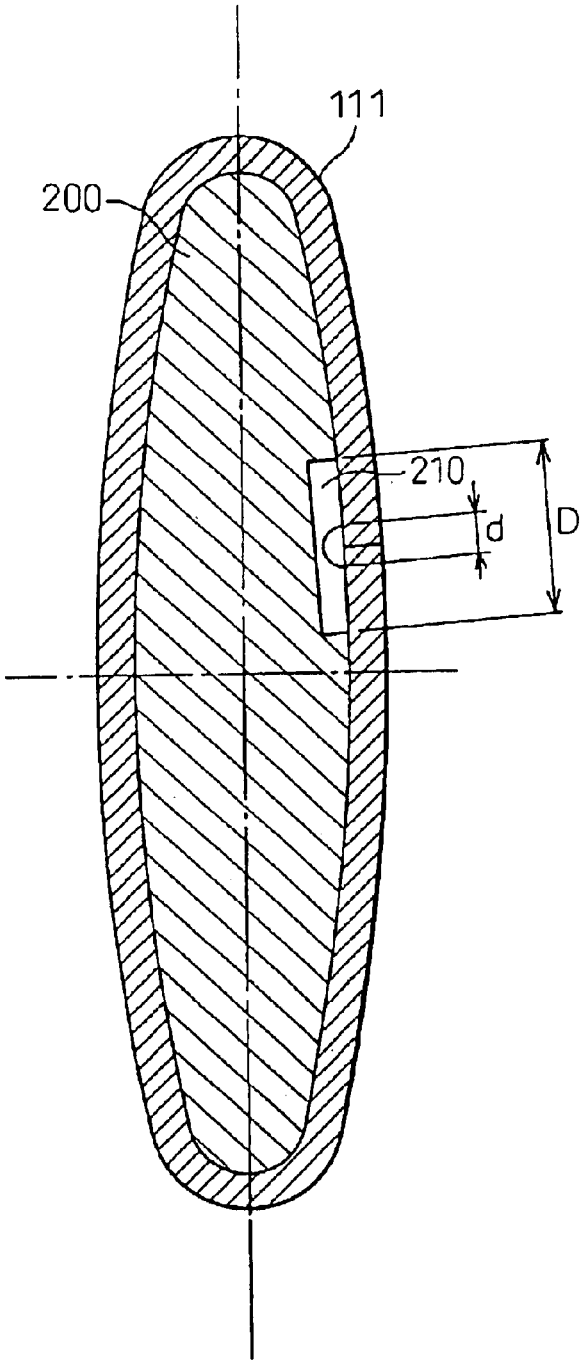
FIG. 7A is a cross-sectional view showing a state in which the tube enlargement jig is inserted into the tube according to the first embodiment of the present invention.
Figure 7B:
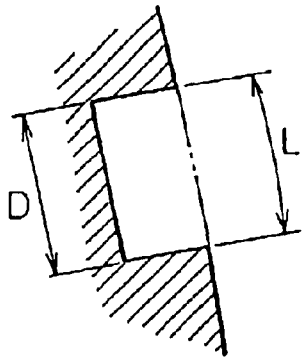
FIG. 7B is an enlarged view of a slit.

FIG. 6A is a front view of a tube enlargement jig 200, FIG. 6B is a view from arrow A of FIG. 6A, and FIG. 7A is a cross-sectional view showing a state in which the tube enlargement jig 200 (the diagonally shaded area) is inserted into the tube 111.

Then, the tube 111 is enlarged to join the fin 112 and the tube 111 mechanically by penetrating the tube enlargement jig 200 through the tube 111.

Here, in an area of the tube enlargement jig 200 corresponding to the padding (the welding beads) of the weld 111*a*, a groove-like slit 210 is provided for avoiding interference with the padding (the welding beads), wherein the slit width D of the slit 210 (see FIG. 7A) is defined so that a ratio (D/L) of the slit width D (the chord length) to the arc length corresponding to the slit 210 is substantially 1 ($0.9 \leqq D/L$) and thus the slit width D of the slit 210 is equal to the padding (welding beads) width d as much as possible.

Next, the effects of this embodiment will be described.

In this embodiment, as the welds 111*a* are provided in the areas that are offset from the curved portions 111*b* where stress concentration is likely to occur, excess stress occurring at the welds 111*a* at the time of tube enlargement can be inhibited. Therefore, even if the welds 111*a* are softened and proof stress (mechanical strength) is reduced at the time of welding, as the stress occurring at the welds 111*a* at the time of the tube enlargement can be prevented from exceeding the proof stress (allowable stress) of the welds 111*a*, the welded tubes can be adopted in the heat exchanger in which the tubes 111 and the fins 112 are joined together mechanically by tube enlargement (the radiator 100 in this embodiment). As a result, the manufacturing cost of the tubes 111 can be reduced in comparison with the case when the seamless tubes are adopted as the tubes 111.

Figure 8A:
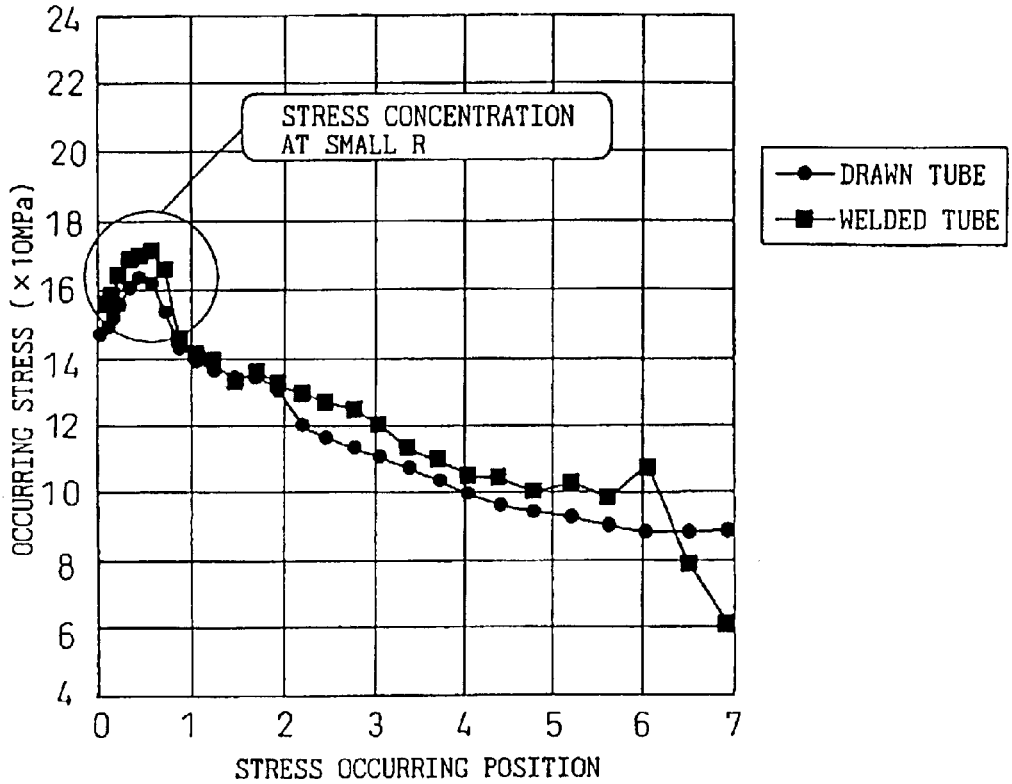
FIG. 8A is a plot showing stress generated at the time of tube enlargement.
Figure 8B:
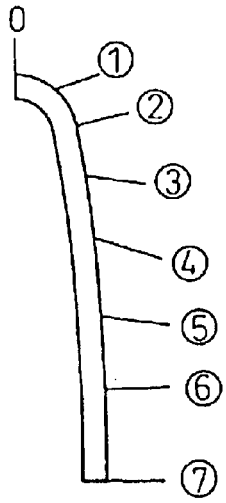
FIG. 8B is an explanatory drawing showing positions where the stress is generated.

Here, it is to be noted that FIG. 8A shows a numerical simulation of the stress occurring at the time of the tube enlargement, and FIG. 8B is an explanatory drawing showing positions where the stress is generated. Thus, as apparent from FIG. 8A, larger stress occurs at the curved portions 111*b*, and the stress occurring in areas that are offset from the curved portions 111*b* is smaller than at the curved portions 111*b*.

A Second Embodiment

Figure 9B:
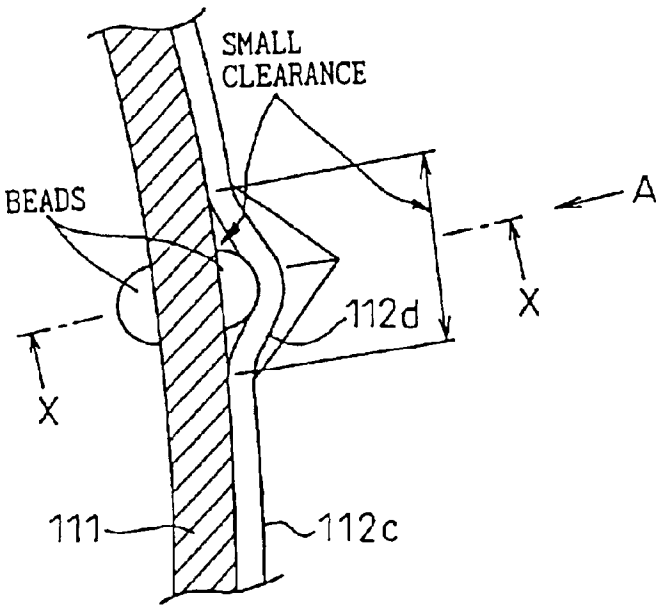
FIG. 9B is an enlarged view of portion A of FIG. 9A.
Figure 9A:
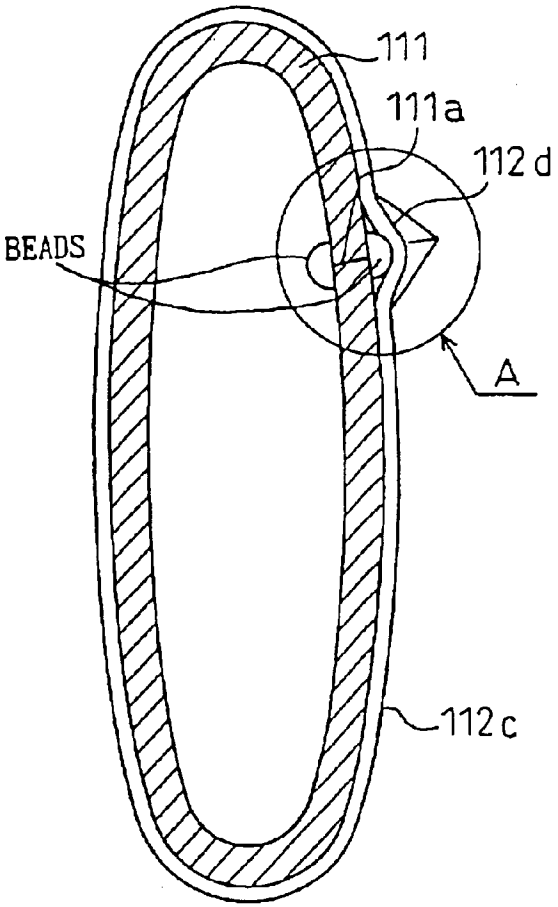
FIG. 9A is a cross-sectional view of a tube according to a second embodiment of the present invention.

Though the padding (the welding beads) formed on the outer circumferential surface of the tubes 111 is cut away in the preceding embodiment, the cutting process for cutting away the padding (the welding-beads) formed on the outer circumferential surface of the tubes 111 is abolished in this embodiment, and, as shown in FIG. 9A, depressions 112*d* that are depressed in the direction of the padding of the welds 111*a* are provided in areas of edges of the insertion holes 112*a* that correspond to the welds 111*a*.

Next, the effects of this embodiment will be described.

Figure 10A:
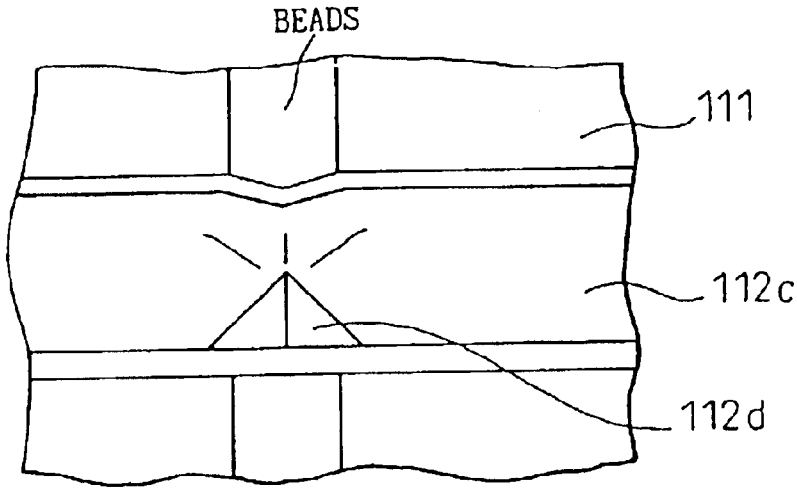
FIG. 10A is a view from arrow A of FIG. 9B.
Figure 10B:
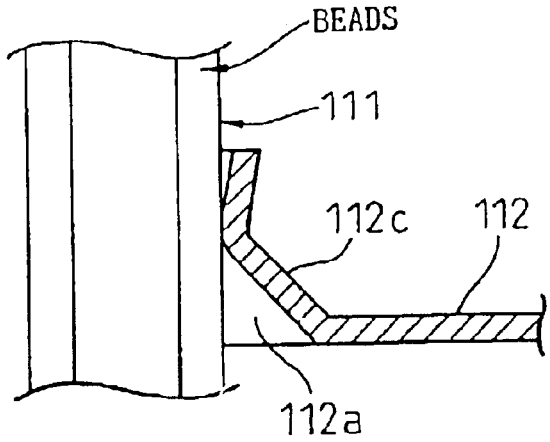
FIG. 10B is a cross-sectional view taken on line X—X of FIG. 9B.
Figure 11B:
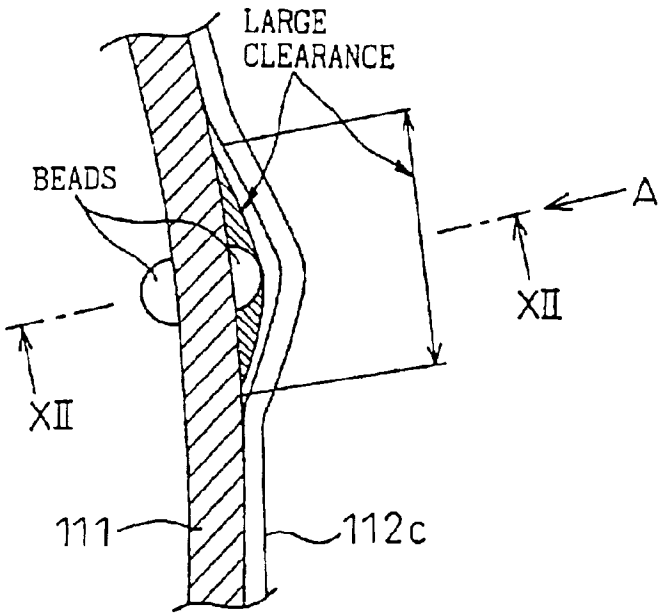
FIG. 11B is an enlarged view of portion A of FIG. 11A.
Figure 11A:
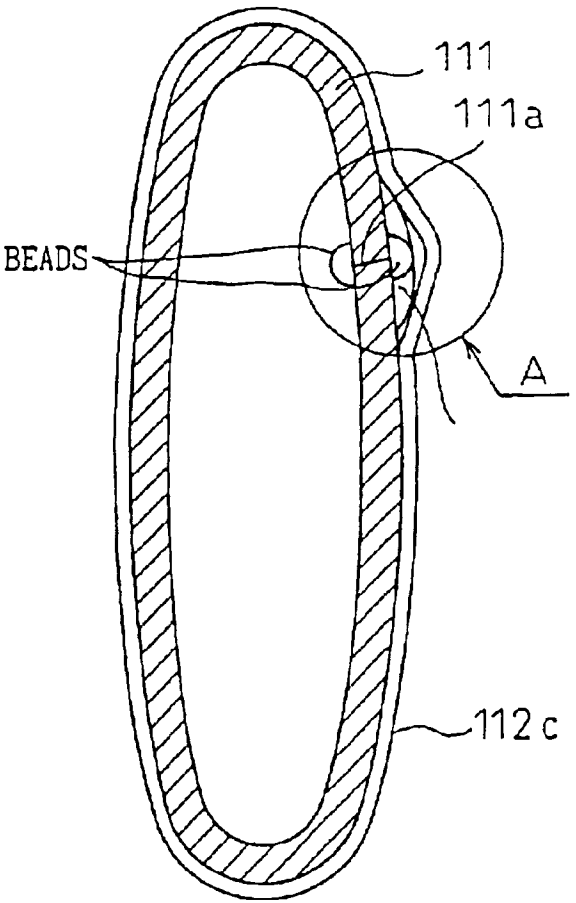
FIG. 11A is a cross-sectional view of a tube according to a comparative example.
Figure 12A:
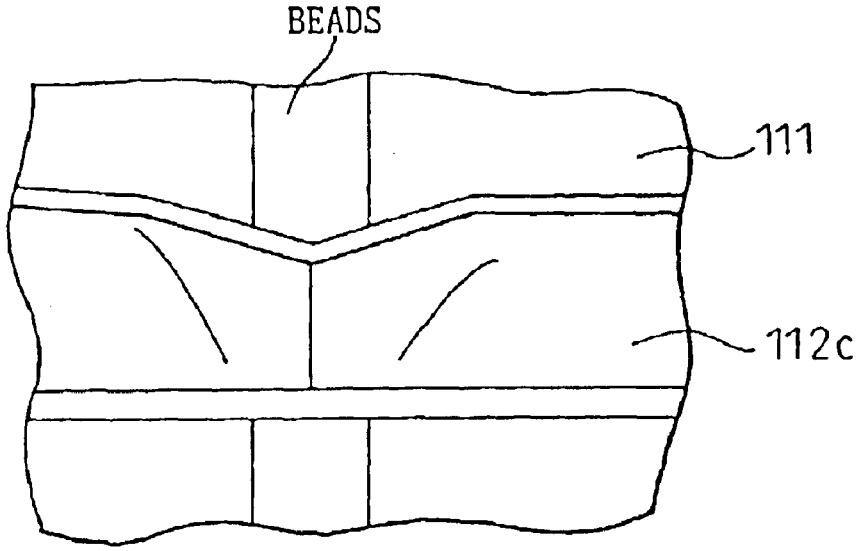
FIG. 12A is a view from arrow A of FIG. 11B.
Figure 12B:
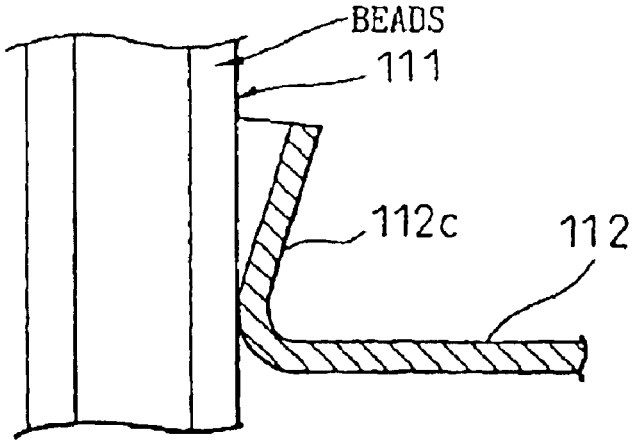
FIG. 12B is a cross-sectional view taken on line XII—XII of FIG. 11B.

FIG. 10A is a view from arrow A of FIG. 9B, FIG. 10B is a cross-sectional view taken on line X—X of FIG. 9B, FIG. 11A is a view showing a case in which the tubes 111 are enlarged when the padding (the welding beads) formed on the outer circumferential surface of the tubes 111 remains and the depressions 112*d* are not provided, FIG. 12A is a view from arrow A of FIG. 11B, and FIG. 12B is a cross-sectional view taken on line XII—XII of FIG. 11B.

As shown in FIGS. 11A, 11B, 12A and 12B, if the tubes 111 are enlarged without providing the depressions 112*d*, as the tubes 111 are deformed plastically so that areas of the insertion holes 112*a* (the burring portions 112*c*) that correspond to the padding (the welding beads) are expanded, relatively large clearances are created between the tubes 111 and the fins 112 in the vicinity of the padding (the welding beads).

In contrast, in this embodiment, as the depressions 112*a* that are depressed in the direction of the padding of the welds 111*a* are provided in the areas of the edges of the insertion holes 112*a* that correspond to the welds 111*a*, the depressions 112*d* act as relief means for mitigating interference between the welding beads and the insertion holes 112*a* (the burring portions 112*c*). Therefore, the clearances created between the tubes 111 and the fins 112 in the vicinity of the padding (the welding beads) are reduced in comparison with the case in which the depressions 112*d* are not provided.

As a result, as contact areas (thus heat conduction) between the tubes 111 and the fins 112 can be prevented from being reduced, heat exchange capacity can also be prevented from being reduced.

In this connection, though the depressions 112*d* are rhombic (in the form of a triangular pyramid) in this embodiment, this embodiment is not limited to such configuration, and the depressions 112*d* may alternatively be a dome-like shape (spherical), for example.

A Third Embodiment

Figure 13B:
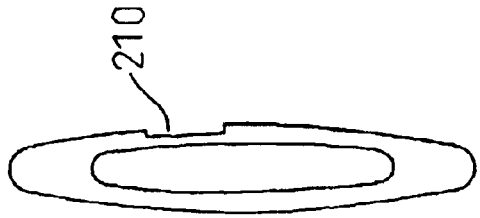
FIG. 13B is a view from arrow A of FIG. 13A.
Figure 13A:
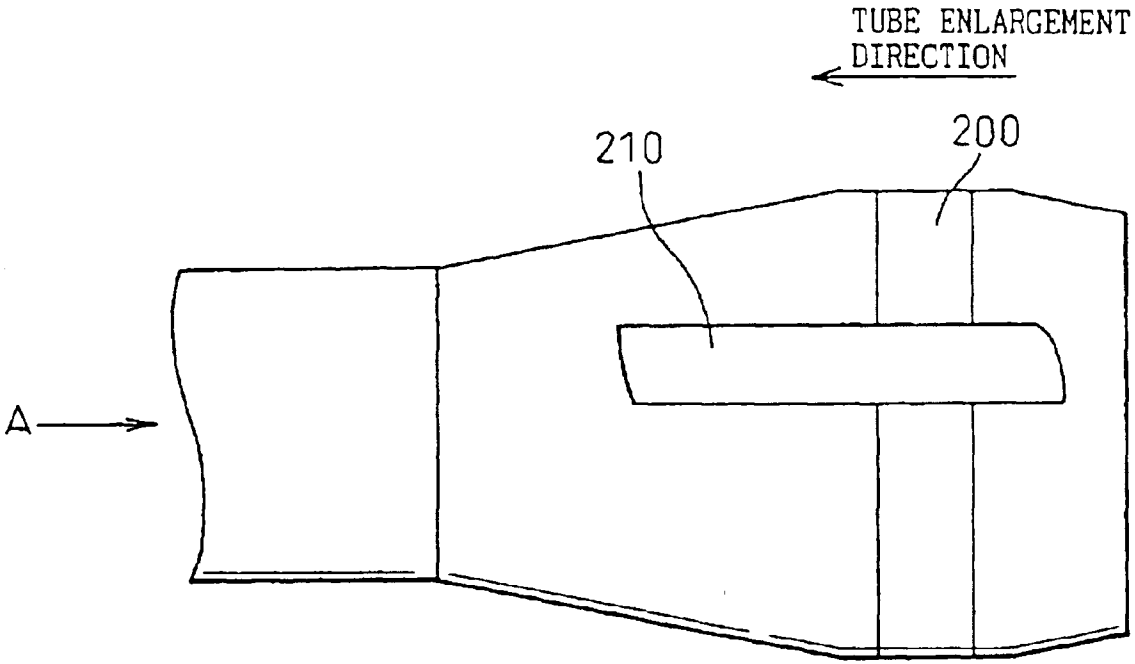
FIG. 13A is a front view of a tube enlargement jig according to a third embodiment of the present invention.

Though the tubes 111 are enlarged by pushing the tube enlargement jigs 200 into the tubes 111 in the embodiment described above, the tube enlargement jigs 200 are penetrated through the tubes 111 by pulled out the tube enlargement jigs 200 in this embodiment. Here, FIGS. 13A and 13B are views showing the tube enlargement jig 200 for pullout.

A Fourth Embodiment

Figure 14:
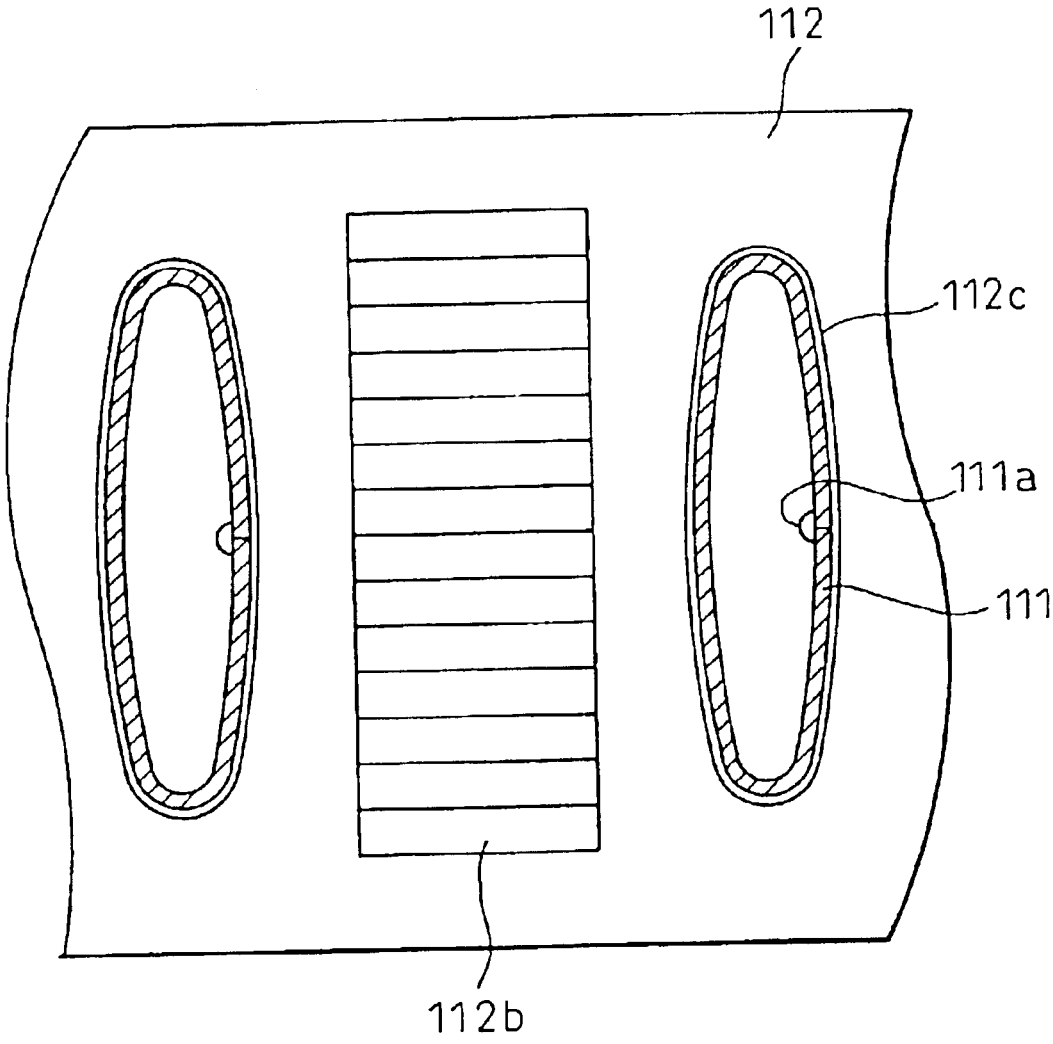
FIG. 14 is a front view showing joining relationship between tubes and a fin according to a fourth embodiment of the present invention.
Figure 15:
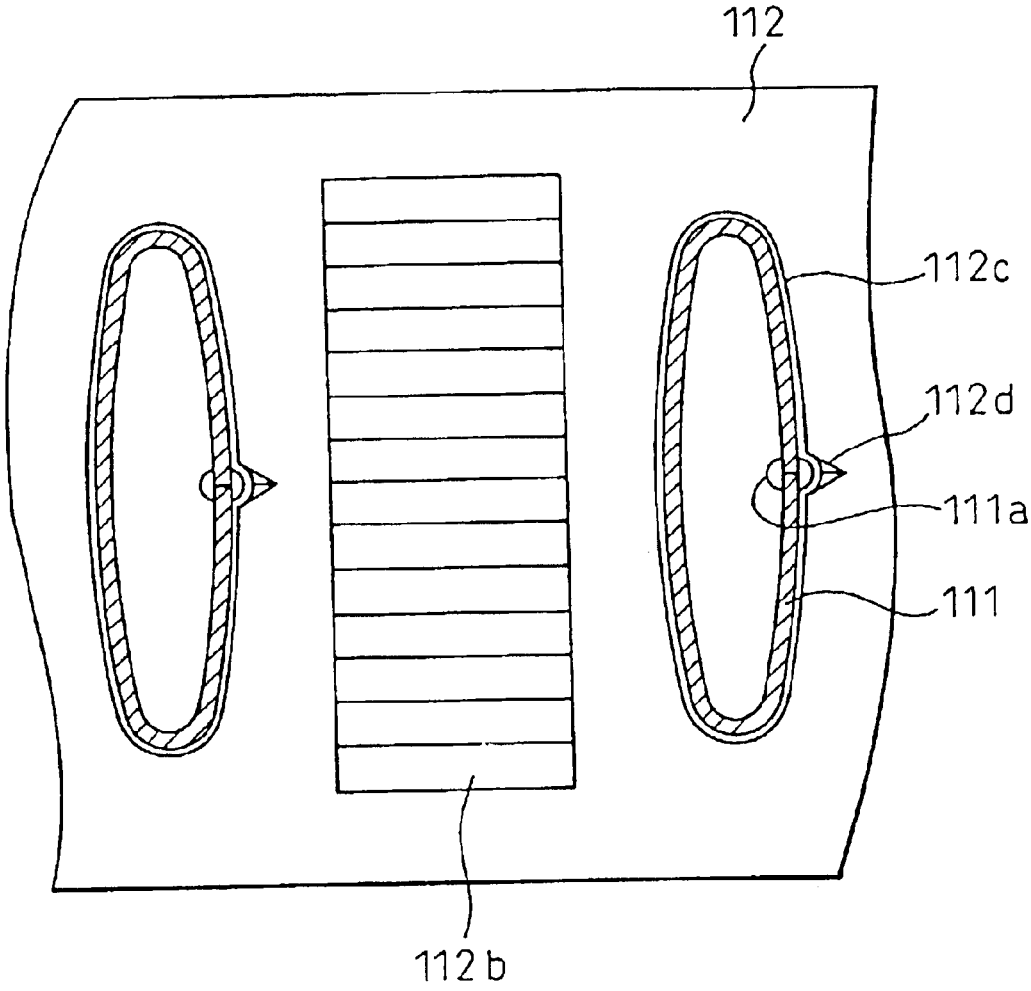
FIG. 15 is a front view showing the joining relationship between the tubes and the fin according to the fourth embodiment of the present invention.

Though the welds 111*a* are provided in the areas that are offset from the areas substantially corresponding to the center position in the length direction W of the tube cross-section in the embodiment described above, the welds 111*a* are provided in the areas substantially corresponding to the center position in the length direction W of the tube cross-section in this embodiment, as shown in FIGS. 14 and 15.

In this connection, FIG. 14 shows an example in which this embodiment is applied to the first embodiment, while FIG. 15 shows another example in which this embodiment is applied to the second embodiment.

Thus, as apparent from FIG. 8A, as the stress occurring at the welds 111*a* can be minimized by providing the welds 111*a* in the areas substantially corresponding to the center position in the length direction W of the tube cross-section, the reliability of the tubes 111 (the welded tubes) can be improved further.

A Fifth Embodiment

Figure 16:
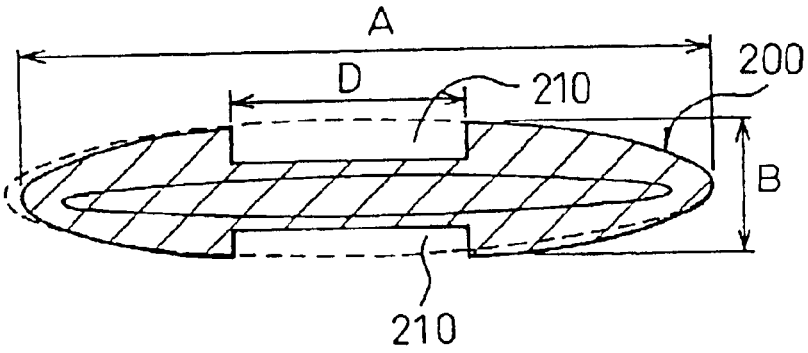
FIG. 16 is a cross-sectional view of a tube enlargement jig according to a fifth embodiment of the present invention.

This embodiment discloses a variation of the tube enlargement jig 200 wherein, more specifically, as shown in FIG. 16, the tube enlargement jig 200 is configured so that the slit width D of the slit 210 provided in an area corresponding to the padding of the welds 111*a* is larger than the padding width d of the welds 111*a* (see FIG. 7A) (D>d), and so that a ratio (=D/A) of the slit width D to the dimension A of the area that is parallel to the slit width D among the outside dimensions of the tube enlargement jig 200, that is, the length dimension A among the cross-sectional dimensions of the tube enlargement jig 200, is 0.32 or less.

Here, when the tube 111 is enlarged by using the tube enlargement jig 200 having the slit 210, the area of the tube 111 corresponding to the slit 210 is not enlarged. In this case, as the ratio (=D/A) of the slit width D to the length dimension A is increased, the clearance between the unenlarged area of the tube 111 and the opening edge of the insertion hole 112*a* is also increased, and therefore, the contact area between the tube 111 and the fin 112 is, in turn, decreased.

Figure 17:
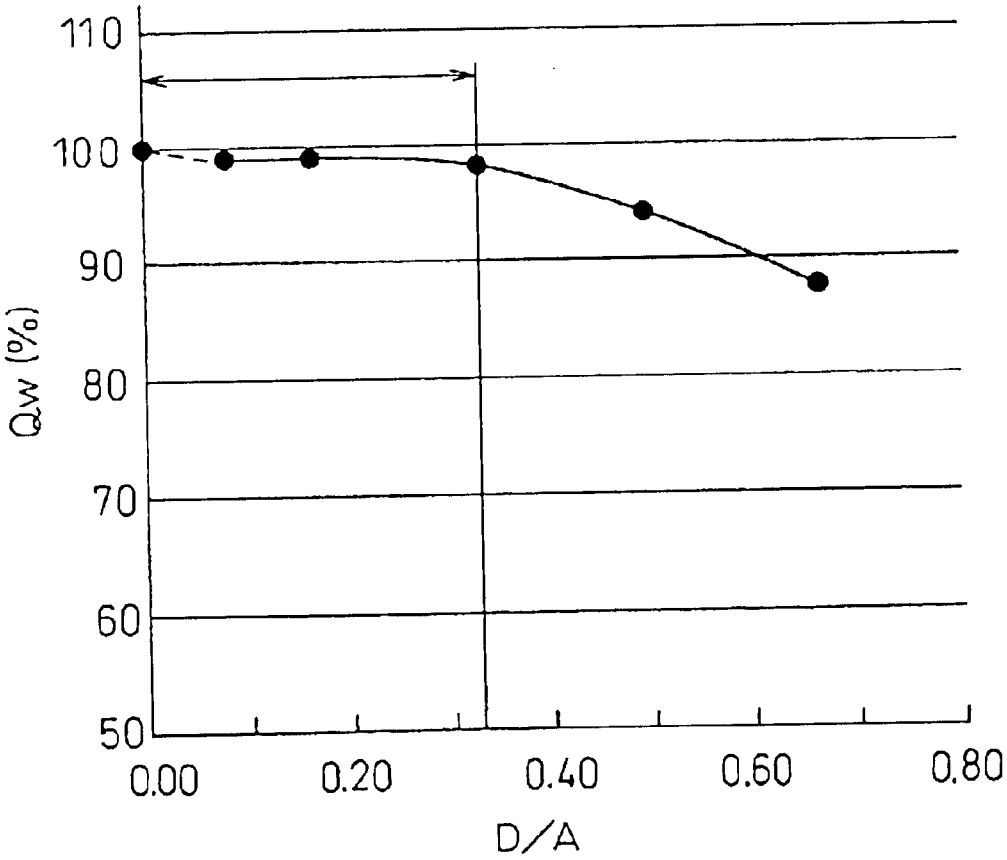
FIG. 17 is a plot showing relationship between a ratio of a slit width D to a length dimension A (=D/A) and heat exchange capacity Qw of a radiator 100.

FIG. 17 is a test result showing relationship between the ratio (=D/A) of the slit width D to the length dimension A and heat exchange capacity (heat dissipation capacity) Qw of the radiator 100, where the heat dissipation capacity Qw is defined so that it is equal to 100 when the fin 112 is joined to the seamless tube without the weld 111*a* by tube enlargement.

As apparent from FIG. 17, as the contact area between the tube 111 and the fin 112 can be prevented from reduced significantly when the ratio of the slit width D to the length dimension A is 0.32 or less, the heat dissipation capacity may be substantially comparable to the one of the seamless tube.

Though the present invention is applied to the radiator in the embodiments described above, the present invention is not limited to such application, and it can be applied to other heat exchangers.

While the present invention has been described in detail with reference to particular embodiments, it will be understood by those skilled in the art that various changes and modifications may be made without departing from the scope and sprit of the present invention.

What is claimed is:

1. A heat exchanger having tubes through which fluid flows, and fins for promoting heat exchange between one fluid flowing through said tubes and air passing between said tubes, in which said tubes and said fins are joined together mechanically by deforming said tubes plastically so as to increase the cross-sectional areas of said tubes in a state in which said tubes are inserted through insertion holes provided in said fins, wherein said tubes are welded tubes manufactured by bending plate material to form flat tubes and then joining seams by welding, welds of said tubes are provided in areas that are offset from curved portions formed at the ends in the lengthwise direction in the tube cross-section of said flat tube, and depressions that are depressed in the direction of padding of said welds are provided in areas of edges of said insertion holes that correspond to said welds, said depressions being formed at burring portions in either a triangular pyramid shape or a dome-like shape.

2. A heat exchanger according to claim 1, wherein said welds are provided in areas that substantially correspond to a center position in the lengthwise direction in the tube cross-section of said flat tube.

3. A heat exchanger according to claim 2, wherein depressions that are depressed in the direction of padding of said welds are provided in areas of edges of said insertion holes that correspond to said welds.

4. A heat exchanger having tubes through which fluid flows, and fins for promoting heat exchange between one fluid flowing through said tubes and air passing between said tubes, in which said tubes and said fins are joined together mechanically by deforming said tubes plastically so as to increase cross-sectional areas of said tubes in a state in which said tubes are inserted through insertion holes provided in said fins, wherein said tubes are welded tubes manufactured by bending plate material in a tubular manner and then joining seams by welding, and depressions that are depressed in the direction of padding of said welds are provided in areas of edges of said insertion holes that correspond to said welds, the depressions being formed at burring portions in either a triangular pyramid shape or a dome-like shape.

5. A method for manufacturing a heat exchanger having tubes through which fluid flows, and fins for promoting heat exchange between one fluid flowing through said tubes and air passing between said tubes, in which said tubes and said fins are joined together mechanically by deforming said tubes plastically so as to increase the cross-sectional areas of said tubes in a state in which said tubes are inserted through insertion holes provided in said fins, wherein said tubes are welded tubes manufactured by bending plate material to form flat tubes and then joining seams by welding, and welds of said tubes are provided in areas that are offset from curved portions formed at the ends in the lengthwise direction in the tube cross-section of said flat tube, the method comprising the steps of:

inserting tube enlargement jigs for enlarging said tubes into said tubes so that slits are positioned in areas that correspond to padding of said welds, wherein said slits are provided for avoiding interference with the padding of said welds, and wherein a slit width (D) of said slits is larger than a padding width (d) of said wells; and joining said tubes and said fins together mechanically by deforming said tubes plastically by using said tube enlargement jigs.

6. The method of manufacturing a heat exchanger according to claim 5 wherein a ration (D/A) of said slit width (D) to a dimension (A) of areas that are parallel to said slit width (D) among outside dimensions is 0.32 or less.

7. The method of manufacturing a heat exchanger according to claim 5 wherein the tubes are enlarged by using the tube enlargement jigs of which the slits are formed at a position that is offset from curved portions that are formed at both ends in the length direction in the tube cross section.

8. A method for manufacturing a heat exchanger having tubes through which fluid flows, and fins for promoting heat exchange between one fluid flowing through said tubes and air passing between said tubes, in which said tubes and said fins are joined together mechanically by deforming said tubes plastically so as to increase the cross-sectional areas of said tubes in a state in which said tubes are inserted through insertion holes provided in said fins, wherein said tubes are welded tubes manufactured by bending plate material to form flat tubes and then joining seams by welding, and welds of said tubes are provided in areas that are offset from curved portions formed at the ends in the lengthwise direction in the tube cross-section of said flat tube, said welds are provided in areas that substantially correspond to a center position in the lengthwise direction in the tube cross-section of said flat tube, the method comprising the steps of:

inserting tube enlargement jigs for enlarging said tubes into said tubes so that slits are positioned in areas that correspond to padding of said welds, wherein said slits are provided for avoiding interference with the padding of said welds, and wherein a slit width (D) of said slits is larger than a padding width (d) of said wells;

joining said tubes and said fins together mechanically by deforming said tubes plastically by using said tube enlargement jigs.

9. The method of manufacturing a heat exchanger according to claim 8 wherein a ration (D/A) of said slit width (D) to a dimension (A) of areas that are parallel to said slit width (D) among outside dimensions is 0.32 or less.

10. The method of manufacturing a heat exchanger according to claim 8 wherein the tubes are enlarged by using the tube enlargement jigs of which the slits are formed at a position that is offset from curved portions that are formed at both ends in the length direction in the tube cross section.

11. A method for manufacturing a heat exchanger having tubes through which fluid flows, and fins for promoting heat exchange between one fluid flowing through said tubes and air passing between said tubes, in which said tubes and said fins are joined together mechanically by deforming said tubes plastically so as to increase the cross-sectional areas of said tubes in a state in which said tubes are inserted through insertion holes provided in said fins, wherein said tubes are welded tubes manufactured by bending plate material to form flat tubes and then joining seams by welding, and welds of said tubes are provided in areas that are offset from curved portions formed at the ends in the lengthwise direction in the tube cross-section of said flat tube, depressions that are depressed in the direction of padding of said welds are provided in areas of edges of said insertion holes that correspond to said welds, the method comprising the steps of:

inserting tube enlargement jigs for enlarging said tubes into said tubes so that slits are positioned in areas that correspond to padding of said welds, wherein said slits are provided for avoiding interference with the padding of said welds, and wherein a slit width (D) of said slits is larger than a padding width (d) of said wells; and joining said tubes and said fins together mechanically by deforming said tubes plastically by using said tube enlargement jigs.

12. The method of manufacturing a heat exchanger according to claim 11 wherein a ration (D/A) of said slit width (D) to a dimension (A) of areas that are parallel to said slit width (D) among outside dimensions is 0.32 or less.

13. The method of manufacturing a heat exchanger according to claim 11 wherein the tubes are enlarged by using the tube enlargement jigs of which the slits are formed at a position that is offset from curved portions that are formed at both ends in the length direction in the tube cross section.

14. A method for manufacturing a heat exchanger having tubes through which fluid flows, and fins for promoting heat exchange between one fluid flowing through said tubes and air passing between said tubes, in which said tubes and said fins are joined together mechanically by deforming said tubes plastically so as to increase the cross-sectional areas of said tubes in a state in which said tubes are inserted through insertion holes provided in said fins, wherein said tubes are welded tubes manufactured by bending plate material to form flat tubes and then joining seams by welding, and welds of said tubes are provided in areas that are offset from curved portions formed at the ends in the lengthwise direction in the tube cross-section of said flat tube said welds are provided in areas that substantially correspond to a center position in the lengthwise direction in the tube cross-section of said flat tube, depressions that are depressed in the direction of padding of said welds are provided in areas of edges of said insertion holes that correspond to said welds, the method comprising the steps of:

inserting tube enlargement jigs for enlarging said tubes into said tubes so that slits are positioned in areas that correspond to padding of said welds, wherein said slits are provided for avoiding interference with the padding of said welds, and wherein a slit width (D) of said slits is larger than a padding width (d) of said wells; and joining said tubes and said fins together mechanically by deforming said tubes plastically by using said tube enlargement jigs.

15. The method of manufacturing a heat exchanger according to claim 14 wherein a ration (D/A) of said slit width (D) to a dimension (A) of areas that are parallel to said slit width (D) among outside dimensions is 0.32 or less.

16. The method of manufacturing a heat exchanger according to claim 14 wherein the tubes are enlarged by using the tube enlargement jigs of which the slits are formed at a position that is offset from curved portions that are formed at both ends in the length direction in the tube cross section.

17. A method for manufacturing a heat exchanger having tubes through which fluid flows, and fins for promoting heat exchange between one fluid flowing through said tubes and air passing between said tubes, in which said tubes and said fins are joined together mechanically by deforming said tubes plastically so as to increase cross-sectional areas of said tubes in a state in which said tubes are inserted through insertion holes provided in said fins, wherein said tubes are welded tubes manufactured by bending plate material in a tubular manner and then joining seams by welding, and depressions that are depressed in the direction of padding of said welds are provided in areas of edges of said insertion holes that correspond to said welds, the method comprising the steps of:

inserting tube enlargement jigs for enlarging said tubes into said tubes so that slits are positioned in areas that correspond to padding of said welds, wherein said slits are provided for avoiding interference with the padding of said welds, and wherein a slit width (D) of said slits is larger than a padding width (d) of said wells; and joining said tubes and said fins together mechanically by deforming said tubes plastically by using said tube enlargement jigs.

18. The method of manufacturing a heat exchanger according to claim 17 wherein a ration (D/A) of said slit width (D) to a dimension (A) of areas that are parallel to said slit width (D) among outside dimensions is 0.32 or less.

19. The method of manufacturing a heat exchanger according to claim 17 wherein the tubes are enlarged by using the tube enlargement jigs of which the slits are formed at a position that is offset from curved portions that are formed at both ends in the length direction in the tube cross section.

* * * * *

UNITED STATES PATENT AND TRADEMARK OFFICE

CERTIFICATE OF CORRECTION

PATENT NO. : 6,772,831 B2
DATED : August 10, 2004
INVENTOR(S) : Tetsuya Yamamoto et al.

It is certified that error appears in the above-identified patent and that said Letters Patent is hereby corrected as shown below:

Column 8,
Lines 44-45, “wells” should be -- welds --.
Line 49, “ration” should be -- ratio --.

Column 9,
Lines 14 and 51, “wells” should be -- welds --.
Lines 19 and 56, “ration” should be -- ratio --.

Column 10,
Lines 26 and 62, “wells” should be -- welds --.
Lines 31 and 67, “ration” should be -- ratio --.

Signed and Sealed this

Twenty-third Day of August, 2005

JON W. DUDAS
*Director of the United States Patent and Trademark Office*